US005503388A

United States Patent [19]

Guenther et al.

[11] Patent Number: 5,503,388

[45] Date of Patent: Apr. 2, 1996

[54] BUFFERED STACKER

[75] Inventors: Kenneth Guenther, Park Ridge, Ill.; John Hamma, Milford, Conn.; John O'Callaghan, Willmette; George Rabindran, Morton Grove, both of Ill.; Anthony Storace, Norwalk, Conn.; Michael Wisniewski, Bowling Brook, Ill.

[73] Assignee: Bell & Howell Company

[21] Appl. No.: 326,124

[22] Filed: Oct. 19, 1994

[51] Int. Cl.[6] ..... B65H 39/10

[52] U.S. Cl. ..... 271/300; 271/305; 271/207; 414/790.3; 414/790.9

[58] Field of Search ..... 271/300, 302, 271/305, 298, 297, 207, 220; 414/789.9, 790.3, 790.9, 791.1; 209/584

[56] References Cited

U.S. PATENT DOCUMENTS

| | | | |
|---|---|---|---|
| 2,765,167 | 10/1956 | Maher . | |
| 2,767,534 | 10/1956 | Nydegger et al. . | |
| 3,599,805 | 8/1971 | Spencer | 414/790.3 X |
| 3,674,143 | 7/1972 | Hunter et al. | 271/305 X |
| 3,799,540 | 3/1974 | Buccicone . | |
| 3,901,797 | 8/1975 | Storace et al. . | |
| 4,426,074 | 1/1984 | Fischer | 271/302 |
| 4,493,484 | 1/1985 | Eyer | 414/790.9 X |
| 4,657,094 | 4/1987 | Mosher et al. . | |

FOREIGN PATENT DOCUMENTS

| | | | |
|---|---|---|---|
| 2820877 | 12/1978 | Germany | 271/302 |

*Primary Examiner*—David H. Bollinger
*Attorney, Agent, or Firm*—Welsh & Katz, Ltd.

[57] ABSTRACT

A buffered stacking apparatus selectively diverts horizontally disposed documents from a main conveying path, then stacks and transports the documents to replaceable receiving receptacles. The apparatus has a primary horizontal conveyor belt with a lower reach defining a horizontal primary conveying path and at least one secondary conveyor belt having an upper reach which, when the secondary conveyor belt is in a horizontal position, is disposed in a lower juxtaposed relation to the lower reach of the primary conveying belt. The buffered stacking system also selectively effects pivotal movement of the secondary conveyor belt from the horizontal position to a second inclined position wherein the reach of the secondary belt is inclined to the lower reach of the primary conveyor belt. Documents being transported along the primary conveying path are diverted along the inclined reach when the secondary conveying belt is inclined. The documents diverted at the selected diverter station are transported by the inclined reach to a corresponding buffer assembly which horizontally stacks and aligns the documents. The buffer assembly includes a sweeping device which engages and selectively sweeps the stacked documents from the buffer assembly to the corresponding receiving receptacle disposed transversely adjacent the buffer assembly.

12 Claims, 4 Drawing Sheets

BUFFERED STACKER

BACKGROUND OF THE INVENTION

The present invention relates generally to an apparatus and system for collecting flat documents and more particularly to a collecting system for horizontally transported documents and having a novel stacking bin assembly and a mechanism for sweeping the stacked documents into removable containers.

Sorting systems convey documents, such as mail, envelopes and the like, along a primary or main path from which the documents may be selectively diverted or sorted according to predetermined criteria such as a zip code as represented on a zip code label. Document sorting systems typically transport the documents in a vertical, on-edge position by a primary conveyor belt. One or more document diverter or sorter stations are disposed along the length of the primary conveyer belt. When supplied with a control signal from a controller or the like, the sorter station typically diverts the documents to a secondary path which is inclined to the primary conveyer path.

A significant drawback of on-edge document conveying systems is that the sorting systems divert the documents by bending the document along a vertical dimension of the document. In some instances, such as when the system is conveying relatively thick flat documents such as telephone directories and bulky catalogs, the document may be resist bending. This resistance to bending interferes with the mechanism for diverting the documents from the conveying path to a stacking station where the documents are collected.

Another significant problem of on-edge document conveying systems occurs when documents are flexible along a horizontal dimension of the document. Certain documents, due to their size and weight, are likely to bend or fold over when oriented in an on-edge position. This bending has a tendency to jam or otherwise interfere with the sorting mechanism.

Another drawback found in present on-edge sorting systems is that receiving containers such as mail bins are configured to contain documents which are stacked in a horizontal relationship. Thus, the document being transported in an on-edge orientation down a conveyer path must be diverted to a secondary path where the document is reoriented to a horizontal attitude before being placed in the stacking bin. This reorientation adds to the complexity of the sorting apparatus structure and operation.

A further drawback found in on-edge sorting systems is that to be efficient, sorting systems should generally be continuous feeding systems. However, the receiving containers will typically be replaced periodically with an empty container, such as when the container is filled with documents. Thus, if the documents are to be placed in a removable container, the conveying system must be stopped while the container is removed and replaced with an empty container. If, instead, a stacking station is used from which the documents are manually transferred to the removable containers, the transferring procedure requires action by an operator which increases the labor requirements of such systems.

It is therefore an object of the present invention is to provide an improved sorting assembly for documents. A related object is to provide an improved sorting assembly particularly adapted to sorting large or bulky documents.

Another object of the present invention is to provide an improved sorting assembly for documents which includes an apparatus for transporting the sorted documents to receiving containers. A related object is to provide such an assembly which allows replacement of the receiving containers while the sorting apparatus continues to operate.

A further object of the present invention is to provide an improved sorting assembly which places sorted documents in a horizontal orientation in receiving containers. A related object is to place the documents in the horizontal orientation while minimizing any reorientation of the documents after the documents have been sorted.

Another object of the present invention is to provide an improved document sorting and stacking assembly which stores a predetermined amount of documents in a buffer stacking station, and then automatically delivers the stack of documents to a collection container after the predetermined amount of documents has accumulated in the buffer stacking station.

SUMMARY OF THE INVENTION

Accordingly, a buffered stacking assembly for selectively diverting horizontally disposed documents from a main conveying path, then stacking and automatically transporting the documents to replaceable receiving containers is provided. The system has a primary horizontal conveyor belt with a lower horizontal reach defining one part of a horizontal primary conveying path, and at least one secondary conveyor belt having an upper reach which, when the secondary conveyor belt is in a horizontal position, is disposed in a lower juxtaposed relation to of the primary conveying belt and defines another part of the conveying path. The buffered stacking system also includes a controlled drive device for selectively effecting pivotal movement of the secondary conveyor belt from the horizontal position to a second inclined position wherein the upper reach of the secondary belt is inclined to the lower reach of the primary conveyor belt. Documents being transported along the primary conveying path are diverted from the primary conveying path and along the inclined reach when the secondary conveying belt is inclined.

The documents diverted at the selected diverter station are transported by the inclined reach to a corresponding buffer assembly which horizontally and sequentially stacks and aligns the documents. The buffer assembly incorporates a sweeping device which engages and selectively sweeps the stacked documents from the buffer assembly to the corresponding receiving receptacle disposed transversely adjacent the stacking station.

DESCRIPTION OF THE PREFERRED EMBODIMENT

Figure 1:
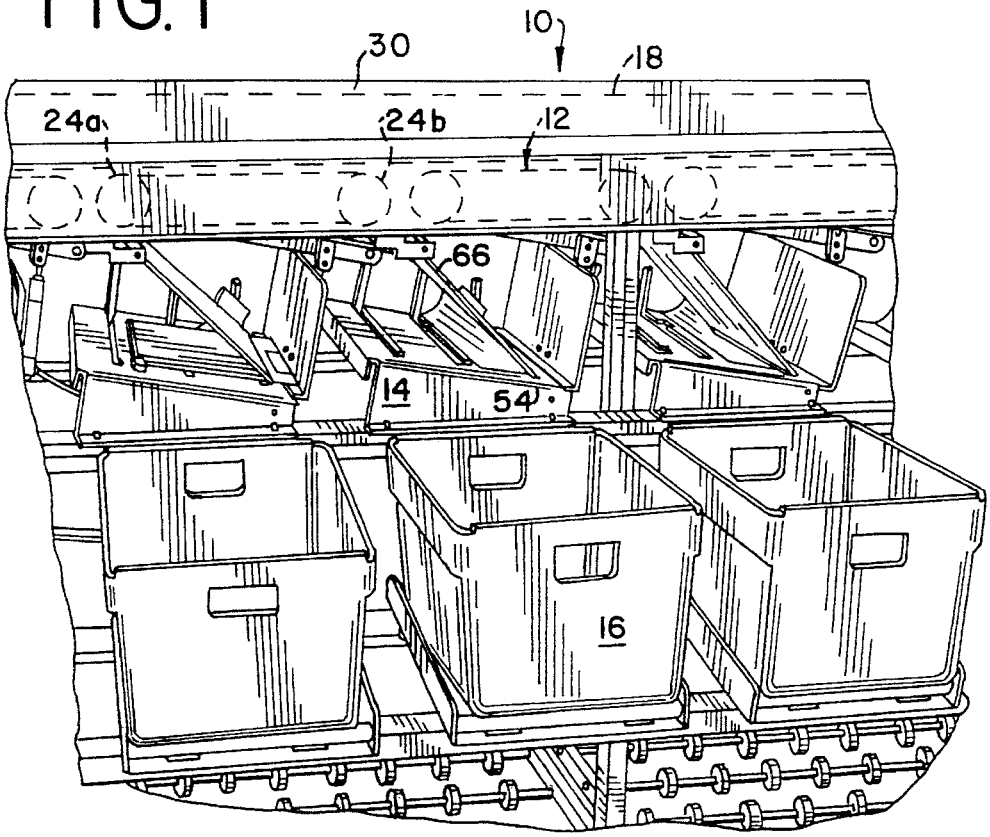
FIG. 1 is a perspective view of a buffered stacker constructed in accordance with the invention.
Figure 2:
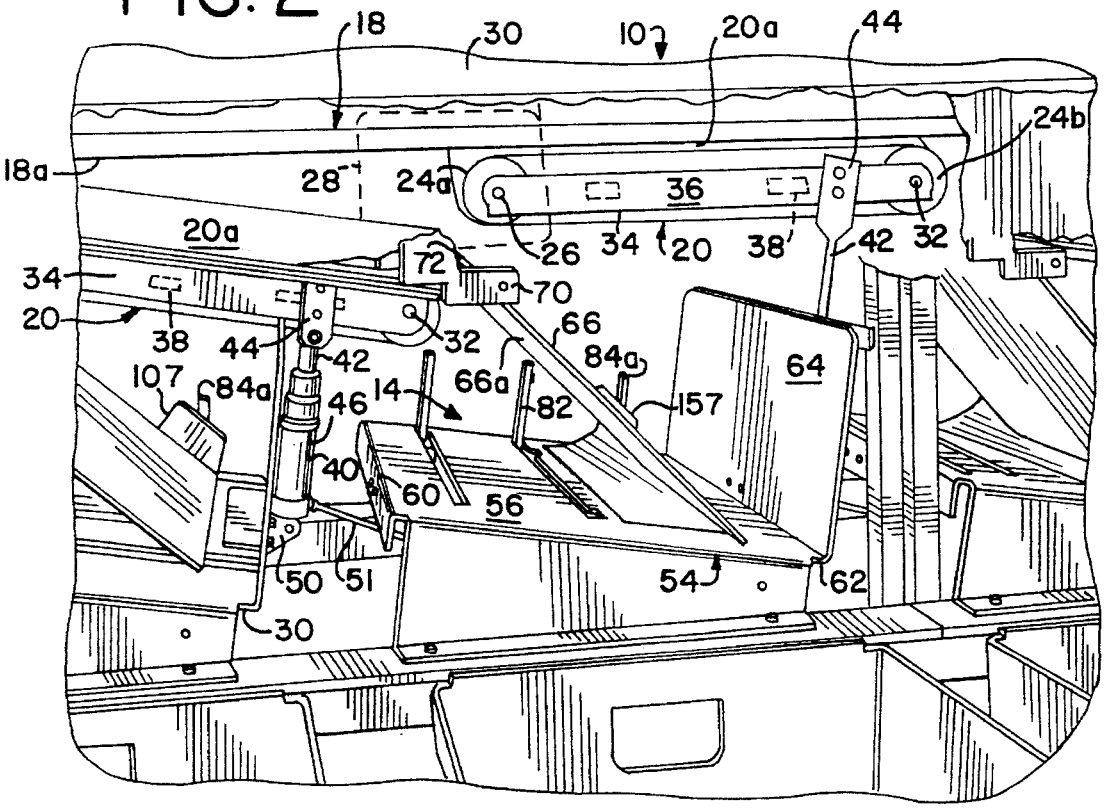
FIG. 2 is an enlargement of a portion of the buffered stacker shown in FIG. 1.

Referring to FIGS. 1 and 2, a buffered stacking system constructed in accordance with the present invention is indicated generally at 10. The buffered stacking system 10 may form a portion of a larger system for conveying and processing large flat documents, such as envelopes, catalogs and the like, which includes a feeder station (not shown), and in which documents are fed in a horizontal, one-at-a-time sequence to a control station (not shown) such as a reader station which determines the appropriate sorting destination for the document. For example, the control station may include an optical character reader or bar code reader which reads indicia on individual documents, such as printed addresses or conventional bar codes. From the information encoded in the indicia, the reader determines an appropriate sorting destination and sends a signal to an appropriate sorting bin.

As will be described, the illustrated diverter and buffered stacking system 10 represents a portion of a document sorter station having a main conveying path along which are positioned a plurality of buffered stacking stations. The control station creates a command signal for each successive document which determines a particular diverter station, such as indicated at 12, at which the document will be diverted from the primary conveying path to a stacking station 14 having a corresponding receiving receptacle 16 into which the stacked documents are transferred for subsequent handling.

The stacking system 10 includes a primary conveying path defined by an upper endless primary conveying belt indicated generally at 18. Each diverter station 12 includes a lower secondary conveyer belt, indicated generally at 20 (FIG. 2) which is positioned along at least a portion of the length of the primary conveyer belt 18. Each secondary conveying belt 20 is disposed serially along the primary conveying belt 18 such that the downstream secondary conveying belt 20 is located further downstream than the upstream adjacent secondary conveying belt. Each of the secondary conveying belts 20, which may also be termed diverter belts, are supported by a pair of rollers indicated by **24*a* and 24*b*. The upstream roller 24*a* is fixedly attached to a horizontally extending shaft 26 having ends which are rotatably supported by a frame 30. The shaft 26 is rotatably driven by a motor, diagrammatically designated at 28 (FIG. 2), to cause rotation of the upstream roller 24*a*, thereby producing continuous downstream movement of the upper reaches 20*a* of the secondary belts 20. The speed that the motor 28 drives the shafts 26 is set so that the upper reaches 20*a* travel at the same linear velocity as the lower reach 18*a* of the primary belt 18**.

Each downstream roller **24*b* is rotatably mounted on a horizontally extending shaft 32 which is supported in a brace 34. Each brace 34 includes a pair of arms 36, one of which extends from each end of downstream roller 24*b* to the corresponding ends of upstream roller 24*a*. Shafts 26 and 32 supporting rollers 24*a*, 26*b* respectively, are journaled in the arms 36. The arms 36 are attached to each other by transverse extending supports 38**.

The brace 34 is pivotable about shaft 26 so that when the brace, and therefore the secondary conveyor belt 20, is in a horizontal or first position, the upper reach **20*a* of the secondary belt 20 lies in juxtaposed contacting relation with lower reach 18*a* of the primary conveying belt 18. Also, when the brace 34 is in the horizontal or first position, the upper reaches 20*a* of the secondary belts 20 and lower reach 18*a* of primary belt 18 form or define the primary path for conveyance of documents introduced into the system 10**.

Figure 3:
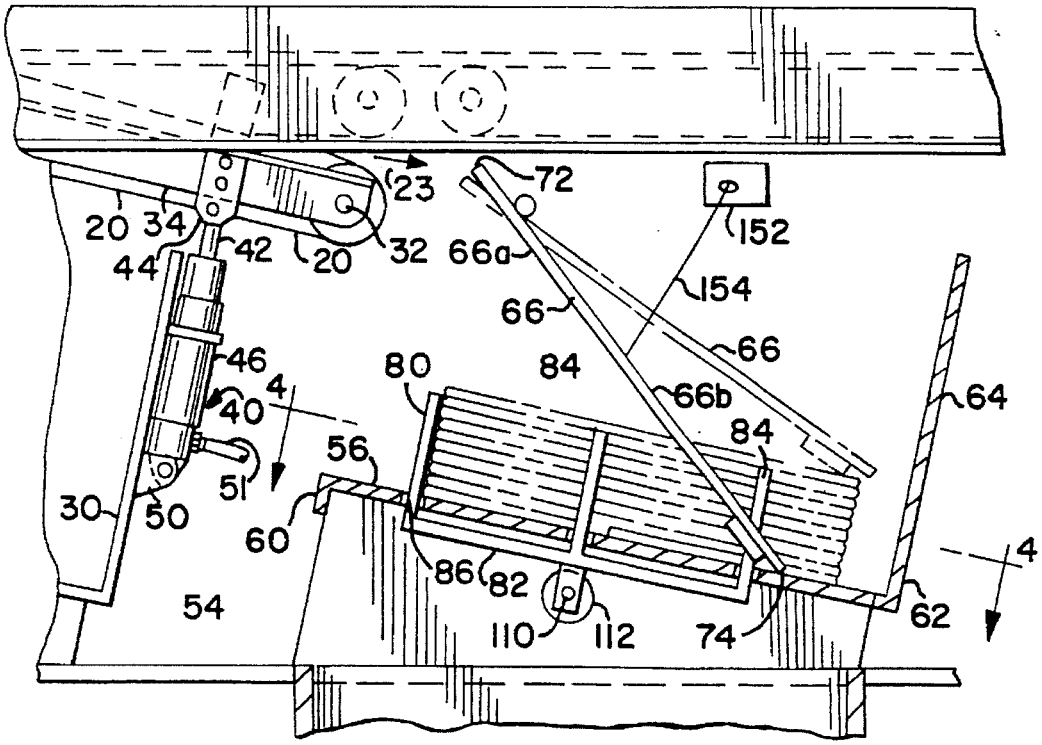
FIG. 3 is a side elevational view of a portion of the buffered stacker of FIG. 1.

Each of the braces 34 and corresponding secondary belts 20 are selectively pivoted about shaft 26 to a second or inclined position, such as illustrated at the left side of FIGS. 2 and 3. This forms a corresponding diverter path 23 (FIG. 3) defined by the inclined reach of the secondary conveyer belt, such as **20*a*. The weight of the document advancing through the diverter station 12, with the secondary belt 20*a* in the inclined position, causes the document to travel downwardly along the diverter path 23. The moving secondary belt 20 then transports the diverted document along the inclined reach 20*a* to the stacker station 14 associated with the particular diverter station 12**.

The brace 34 may be selectively pivoted between the inclined position to the horizontal position and is supportably maintained in the horizontal position by a pivoting means, such as a dual acting pneumatic cylinder 40. The upper or piston end 42 of the pneumatic cylinder 40 is rotatably connected to the bottom of a bracket 44 which is attached to the brace 34 toward the downstream end of the brace. The cylinder end 46 of the cylinder 40 is supported by a bracket 50 attached to the frame 30 of the stacking system 10. A source of pressurized air (not shown) selectively supplies pressurized air to the pneumatic cylinder 40 through hose 51 to displace the piston end 42, thereby pivoting the brace 34 between the horizontal position and the inclined position illustrated in FIGS. 2 and 3.

The document diverter station 12 diverts documents from the primary conveying path into the stacking station 14. Referring to FIGS. 2 and 3, the stacking station 14 includes a buffer device 54 for temporarily containing the documents which have been diverted to the stacking station, and arranging the diverting documents so that the documents are generally horizontal and disposed in a generally vertical stack. The buffer device 54 has a floor 56 which is downwardly sloped from a forward or upstream end 60 towards a downstream end 62. As illustrated in FIG. 2, when the secondary conveying belt 20 is in the inclined position, the upstream end 60 of the floor lies just forward of the downstream shaft 32 of the diverter station 12. Extending upward at a slight downstream angle from the downstream end 62 of the floor 56 is end plate 64 which laterally supports and vertically aligns the documents which are diverted into the buffer device 54 as each incoming document abuts plate 64.

Referring to FIGS. 2 and 3, the stacking station 14 also includes a generally planar guide plate 66 which guides diverted documents from the diverting station 12 to the buffer device 54. The plate 66 is hingeably mounted to a pair of arms 70 which are rigidly attached to the frame 30. The arms 70 extend outward from the plate 66 in close proximity to the upstream end 72 of the plate so that the plate is generally angled downward from the upstream end to the downstream end. The upstream end 72 is positioned above and slightly downstream of the upper reach **20*a* of secondary conveying belt 20 when the diverter station 12 is in the inclined position. A downstream end of a document which is being transported along the secondary conveying belt 20 in the inclined position strikes the underside 66*a* of guide plate 66 which alters the path of the document so that the document travels to the inclined floor 56. Upon landing on the floor 56, the inclination of the floor causes the document to slide downstream so that its downstream edge contacts end plate 64. The contact between the downstream end of the document and end plate 64** aligns the downstream ends of diverted documents with the end plate.

Subsequent documents transported by the secondary conveyor belt 20 strike the underside 66*a* of guide plate 66 and fall on top of the previously diverted documents. Because the previously diverted documents rest in an inclined position on the floor 56, the newly diverted documents slide downstream until the downstream edge contacts the end plate 64 thereby aligning the downstream ends of all diverted documents. Thus, the stacking station 14 aligns the downstream ends of the diverted documents.

The downstream end 74 of the guide plate 66 rests on top of the uppermost document which is stacked on the inclined floor 56. Because the guide plate 66 is hingeably mounted, as more documents are stacked in the buffer device 54, the downstream end 74 of the guide plate 66 raises, thus rotating the guide plate in a generally counterclockwise manner as shown in shadow in FIG. 3.

Figure 4A:
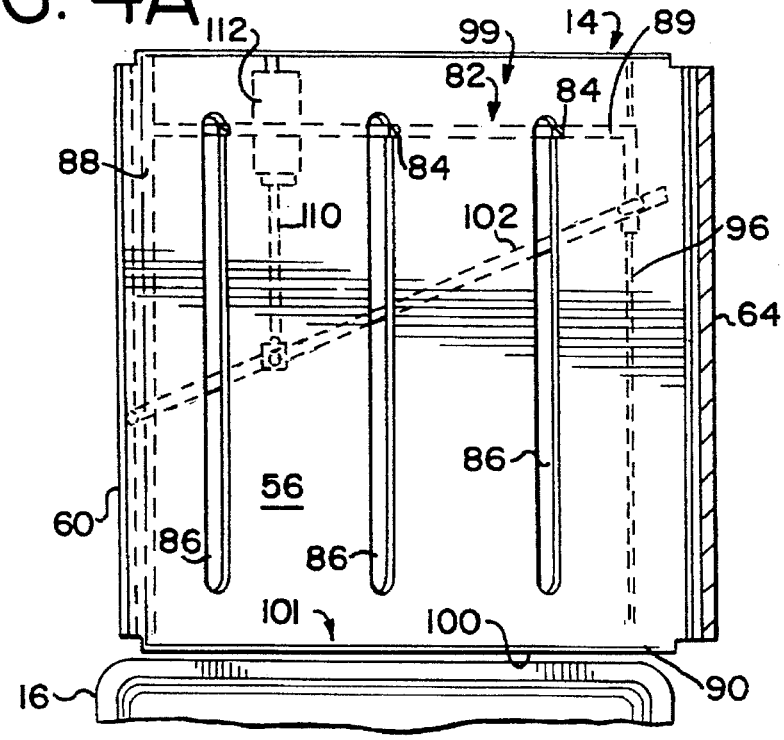
FIG. 4A is a top plan view of a stacker station forming part of the buffered stacker of FIG. 1 taken generally along line 4—4 in FIG. 3 and in the direction generally indicated.
Figure 5:
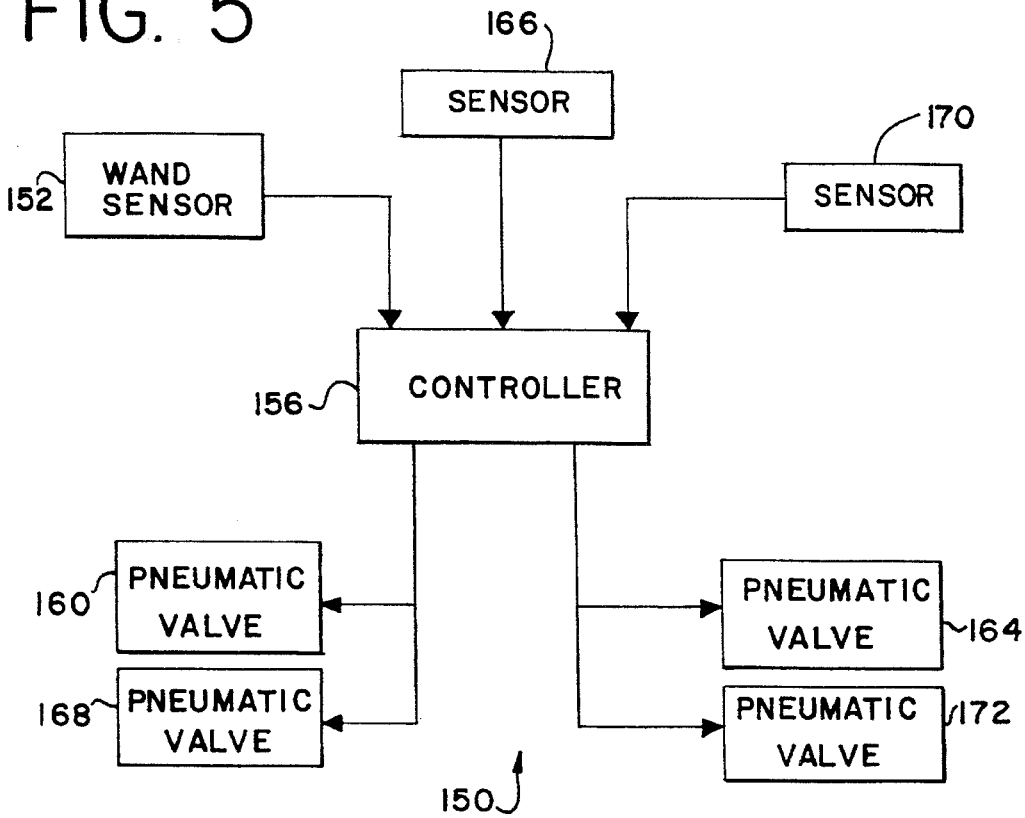
FIG. 5 is a diagrammatic view of a control system forming a part of the buffered stacker of FIG. 1.

Referring to FIGS. 3, 4A and 5, the stacking station 14 also includes an assembly 80 for selectively transporting documents which have been stacked in the buffer device 54 to the adjacent receiving receptacle 16 which corresponds to that stacking station. The transporting assembly 80 transports the documents so that the documents are disposed in the receiving receptacle 16 in a generally horizontal orientation.

Figure 4B:
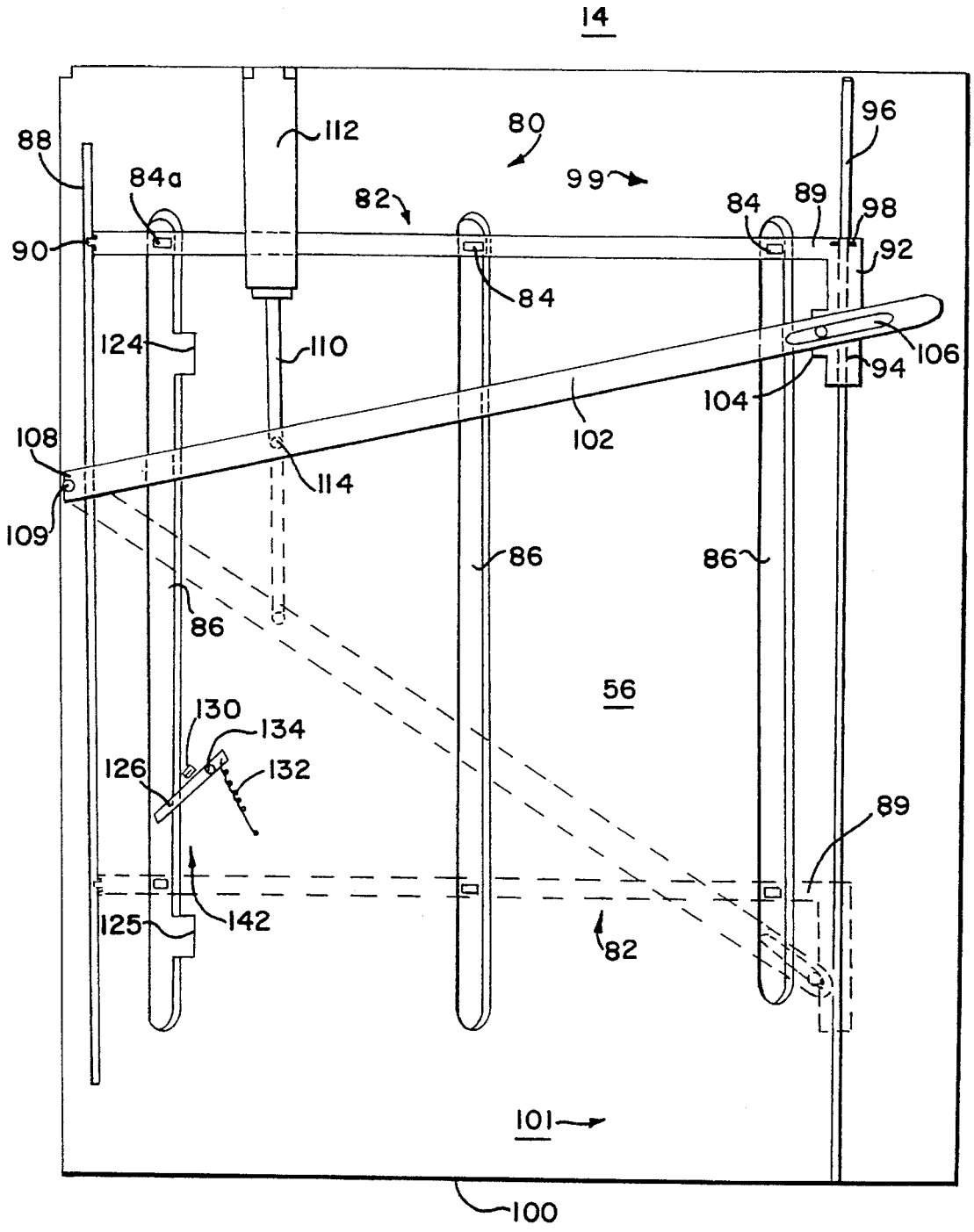
FIG. 4B is a bottom plan view of the stacker station of FIG. 4A.
Figure 4C:
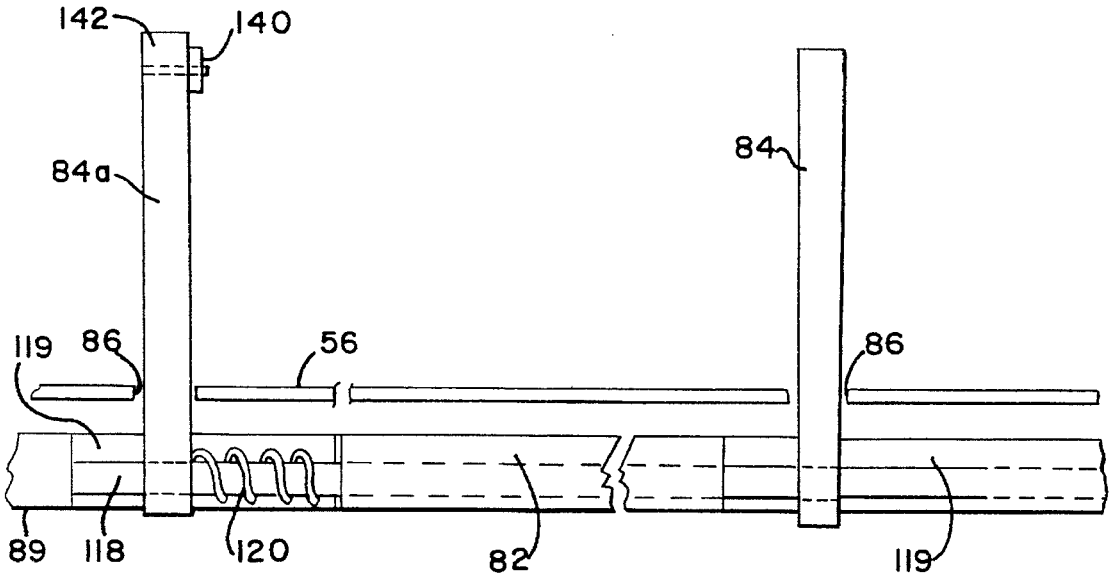
FIG. 4C is an elevational view of a prong forming a part of the stacker station of FIG. 4A.

Referring now to FIGS. 4A, 4B, and 4C, the transporting assembly 80 includes a forklike sweeper 82 having at least one and preferably three pivoting tines or prongs 84 which extend through and travel along slots 86 formed in the inclined floor 56. The slots 86 extend in a direction generally transverse to the document conveying path. The outer end of the slots 86 are in close proximity to the outward edge 100 of the inclined floor 56.

Referring to FIG. 4B, the sweeper 82 includes an "L" shaped retainer bar 89. An upstream or first end 90 of the bar 89 is slidably disposed within an elongated slide bracket 88. A downstream or second end 92 of the bar 89 forms a throughbore 94 for slidably receiving a fixed guide rod 96. The throughbore 94 is lined with bushings 98 to facilitate the sliding of the bar 89 along the rod 96. The guide bracket 88 and the guide rod 96 are parallel to each other and to the slots 86 so that as the sweeper 82 slides along the bracket and rod, the bar 89 is maintained perpendicular to the transverse slots 86 while riding along the path of the slots. The sweeper 82 moves between an inward position, generally shown as 99, and an outward position, generally shown as 101.

The sweeper 82 includes a pivot arm 102 pivotally attached to downstream end 92 of the retainer bar 89 by a stud 104 which extends generally downward from the downstream end 92 and through a slot 106 formed in one end of the pivot arm 102. The other end 108 of the pivot arm 102 is pivotally attached to the underside of inclined floor 56 to form a pivot point 109.

To reciprocally pivot the pivot arm 102 about the pivot point 109, the pivot arm is operably attached to a rod 110, slidably extending from an actuating cylinder 112. The cylinder 112 is preferably a double acting cylinder such that compressed air or other suitable power medium may be introduced into the cylinder 112 to cause reciprocal outward and inward movement of the rod 110. The rod 110 is attached to the pivot arm 102 at a point 114 intermediate the pivot point 109 and the attachment point where the retainer bar 89 is movably mounted to the pivot arm 102. Thus, the outward movement of the cylinder rod 110 causes a magnified outward movement of the retainer bar 89, such that the retainer bar and the associated prongs 89 move a greater transverse distance to the outward position 101 upon a given movement of the rod.

When the rod 110 is in a retracted position, the sweeper 82 is at the most inward position 99. Initially, the sweeper 82 is in the inward position 99 such that documents being deposited on the top of the floor 56 fall between the prongs 84 and the outward end 100 of the floor. When the rod 110 is extended, the rod causes the pivot arm 102 to displace the sweeper 82 toward the outward position 101.

In operation, the outward movement of the sweeper 82 causes the prongs 84 to push the documents in the buffer device 14 outward toward the corresponding receiving receptacle 16. The speed at which the sweeper 82 and, therefore the documents, are pushed outward is preferably at a velocity which maintains the horizontal orientation of the documents between the stacking station 14 and the receiving receptacle 16. After the sweeper 82 has been pushed to the outer end of the slots 86 and the documents have been transported to the receiving receptacle 16, air is introduced into the actuating cylinder 112 to cause retraction of the sweeper 82 back to the inward position 99 so that additional documents may be stacked in the buffer device 54 of the stacking station 14.

Referring to FIG. 4C, the prongs 84, 84*a* are fixedly attached to a connecting axle 118 which is rotatably housed in the retainer bar 89. The prongs 84, 84*a* extend outward from the connecting axle 118 through notches 119 formed in the retaining bar 89. The notches 119 and prongs 84 are configured so that when the prongs are in an upright position and extend upward through the slots 86 in a direction generally normal to the plane of the inclined floor 56, the prongs may only rotate in a direction outward toward the outward edge 100 of the floor 56 (FIG. 4A). A spring 120 extends about the connecting axle 118 and is attached to the axle and retaining bar 89 to bias the prongs 84, 84*a* toward the upright position and allow the prongs to rotate or fold-down parallel to or beneath the plane of the inclined floor 56 as described below.

As best seen in FIG. 4B, one of the slots 86 forms an inward notch 124 and an outward notch 125 disposed toward opposite ends of the slot. Between the notches 124, 125, a lever 126 is pivotally attached to the underside of the floor 56. The lever 126 is biased against a fixed stop 130 by a spring 132 or other suitable biasing means. When the lever 126 contacts the stop 130, one end of the lever extends across the slot 86 and can only pivot in one direction. As the sweeper 82 moves from the inward position 99 to the outward position 101, prong 84*a* contacts the lever 126 pivoting the lever out of the way of the advancing prong. As the prong 84*a* continues to move forward, the lever returns to its normal position biased against the stop 130.

When the retaining bar 89 and prongs 84 retract toward the inward position 99 and the prongs contact the lever 126, the lever is prevented from pivoting by stop 130. The contact between the lever 126 and the prongs 84 rotates the prongs and shaft 118 forward passing the prongs through the slots 86 so that the prongs extend below the floor 56. A guide wheel 140 mounted on the tip 142 of prong 84*a* passes through the outward notch 125 as the prongs 84, 84*a* rotate. As the retaining bar 89 and rotated prongs 84 continue inward, the guide wheel 140 contacts the underside 142 of the inclined floor 56 along the length of the slot 86. Thus, all of the prongs 84, 84*a* remain rotated under the inclined floor 56 as the sweeper 82 retracts toward the inward position 99. When the sweeper has fully retracted to the inward position 99, the guide wheel 140 is vertically aligned with the inward notch 124 and the bias force of the spring 120 rotates the prongs 84, 84*a* back to the upright position with the guide wheel passing through the inward notch 124.

Thus, the prongs 84 are in the upright position during outward movement of the sweeper 82 such that documents deposited in the stacking station 14 are swept outward toward the corresponding receiving receptacle 16. During inward movement of the sweeper 82, the prongs are rotated forward and remain rotated forward, extending below the plane of the inclined floor 56, so that the prongs do not interfere with incoming documents or documents diverted during the sweeping procedure.

Referring to FIGS. 3 and 5, the stacking station 14 also includes a control system 150 for selectively operating the transporting assembly 80 responsive to the height of the stack of documents residing in the buffer device 54. The control device 150 includes a wand sensor 152 which senses the height of the stack of documents through a determination of the angular position of the guide plate 66. The wand sensor 152 is preferably a switch which is activated by movement of the backside **66*b* of the guide plate 66. Rotation of the guide plate 66 due to the stacking of documents in the buffer device 54 causes movement of a wand 154 and activation of the sensor wand 152. Other switching mechanisms responsive to movement of guide plate 66 may be equally substituted for switch 152 and wand 154. The output of the wand sensor 152 is transmitted to a controller 156 forming a part of the control system 150. In response to the output from the wand sensor 152, the controller 156 sends a control signal to actuate the pneumatic valves 160, 164. The pneumatic valves 160, 164 control the supply of pressurized air to the actuating cylinder 112 to cause inward and outward movement of the rod 110, and therefore, the sweeper 82**.

Referring to FIG. 2, the guide plate 66 includes a kicker plate 157. The kicker plate 157 is a rounded plate which extends upward from the inner side edge of the guide plate transversely in line with the downstream prong 84 of the sweeper 82. If the guide plate 66 is not rotated upward sufficiently for the guide plate to clear the upper tip of the downstream prong 84 and the sweeper 82 is actuated, the downstream prong strikes the kicker plate 157 which forces the guide plate 66 upward to clear the sweeper.

Referring now to FIGS. 2 and 5, in operation the documents are transported to the buffer stacking system 10 and are fed into the horizontal primary conveying path between the upper primary conveying belt 18 and the series of secondary conveying belts 20. The secondary conveying belts 20 are positioned in the horizontal position, and therefore, the upper reaches **20*a* of the secondary belts lie in juxtaposed contacting relation with the lower reach 18*a* of the primary conveying belt. The lower reach 18*a* of the primary belt 18 and upper reaches 20*a* of the secondary conveyor belts 20 engage the upper and lower surfaces of each document and transport the document along the primary conveying path at the same velocity as the adjacent belt reaches 18*a*, 20*a***.

The control system 150 may include a sensor 166 disposed at the beginning of the conveying path to determine when the leading edge of a document passes the sensor, thereby sensing when the document enters the sorting system 10. The controller 156 then calculates when to activate the particular diverter station 12 at which the document is to be diverted. The controller 156 uses as inputs the velocity of the document, which is equivalent to the velocity of the belt reaches **18*a*, 20*a* of the conveying belts 18, 20, and the time the document entered the sorting system 10**.

When a document reaches a diverter station 12 where the document is to be diverted from the primary path, the controller 156 activates a second pneumatic valve 168 to introduce pressurized air into the pneumatic cylinder 40 to retract the piston end 42 so that the secondary conveying belt 20 rotates about the shaft 26 to the inclined position as shown in FIG. 3.

The weight of the document and the friction between the secondary conveying belt 20 and the document cause the document to travel along the inclined diverting path 23 (FIG. 3). The linear movement of the upper reach **20*a* of the secondary conveying belt 20 propels the diverted document toward the inclined guide plate 66. The document strikes the upstream face 66*a* of the guide plate 66 and is directed by the guide plate to the buffering device 54**.

After the document has been transported into the stacking station 14, the controller 156 activates the pneumatic switching valve 168 to supply air to the actuating cylinder 40. The control system may also include a sensor 170 which is located to sense the trailing edge of the document leaving the secondary belt 20 and sends a signal to the controller 156 to initiate activation of a pneumatic valve 172. The pressurized air in the cylinder 40 causes the rod end 42 to move generally vertically upward and rotate the brace 34, causing the secondary conveying belt 20 to rotate back to the horizontal position, such that the upper reach **20*a* of belt 20 is horizontally aligned and adjacent the primary conveying belt 18**.

As documents are diverted into the buffering device 54, the uppermost document pushes up the downstream end 74 of the guide plate 66 causing the guide plate to rotate about the shaft 72. The wand 154 contacts the backside **66*a* of the guide plate 66 which moves the wand upward. When the wand has reached a predetermined position, the controller 156 activates the pneumatic valve 160 to supply pressurized air to the actuating cylinder 112. The supply of pressurized air to the actuating cylinder 112 causes the rod 110 to force the sweeper 82 outward. The outward movement of the sweeper 82 pushes the stacked documents outward from the buffering device 54 and into the receiving receptacle 16. The documents are pushed outward at a velocity such that as the documents fall into the receiving receptacle 16, the documents maintain their general horizontal orientation. The stacking station 14 is then ready to receive additional documents. When the sweeper 82 and rod 110 reach the end of their outward path, the control device 150 activates the pneumatic valve 164 to supply air to the actuating cylinder 112 to cause the rod 110 and sweeper 82 to move inward to their original position. As the sweeper 82 moves inward, the prongs 84 are rotated to a position below the floor 56 so that the prongs do not contact any documents which have been diverted to the stacking station 14 during the sweeping movement. When the sweeper 82 reaches the inward position the prongs 84** rotate back into the vertical position.

When the documents within the receiving receptacle 16 reach a desired height, the receiving receptacle may be removed and replaced by an empty receiving receptacle. The document sorter may continue to operate even as sorted documents are being removed from the stacking system 10 through replacement of the receiving receptacle as a result of the buffering action of buffer device 54.

A specific embodiment of the novel buffered stacker according to the present invention has been described for the purposes of illustrating the manner in which the invention may be made and used. It should be understood that implementation of other variations and modifications of the invention in its various aspects will be apparent to those skilled the art, and that the invention is not limited by the specific embodiment described. It is therefore contemplated to cover by the present invention any and all modifications, variations, or equivalents that fall within the true spirit and scope of the basic underlying principles disclosed and claimed herein.

What is claimed is:

1. An apparatus for selectively diverting a plurality of horizontally disposed documents from a main conveying path, and stacking and transporting the documents to replaceable receiving receptacles, the system comprising:

a primary conveyor belt defining a primary conveying path;

at least one secondary conveyor belt having a reach disposed in a lower juxtaposed relation to a lower horizontal reach of said primary conveying belt when said secondary conveyor belt is in a first position;

means for selectively effecting pivotal movement of said secondary conveyor belt from said first position to a second position wherein said reach of said secondary belt is inclined to said primary conveyor belt, the documents being diverted from said primary conveying path along said inclined reach when said secondary conveying belt is in said second position;

buffer means receiving documents diverted along said inclined reach and generally horizontally stacking a plurality of the documents; and sweeping means for selectively engaging and sweeping the stacked documents from said buffer means to the corresponding receiving receptacle disposed transversely adjacent said buffer means.

2. The apparatus of claim 1 wherein said sweeping means includes means for sweeping the plurality of documents when the height of the stack of documents within the buffer means reaches a predetermined height.

3. The apparatus of claim 1 wherein said buffer means includes a generally planar floor having a portion disposed below and downstream of an end of said secondary conveyor belt in said inclined position.

4. The apparatus of claim 3 wherein said sweeping means includes at least one prong extending upward through a corresponding transverse slot formed in said floor, said prong operatively attached to means for selectively reciprocating the prong in a transverse direction relative to said floor wherein said prong engages the stack of documents to push the stack transversely outward into the receiving receptacle.

5. The apparatus of claim 4 wherein said sweeping means further includes folding means for selectively folding said at least one prong substantially parallel to said floor during an inward transverse movement of said at least one prong.

6. The apparatus of claim 5 wherein said sweeping means further includes guide means for selectively maintaining said folded position of said at least one prong during said inward transverse movement.

7. The apparatus of claim 6 wherein said guide means includes a roller means connected to said at least one prong where said roller means is adapted to be in operative contact with said buffer means during said inward transverse movement.

8. The apparatus of claim 1 further including guide plate means having a lower downstream edge adapted to contact documents sequentially stacked in the buffer means, and for guiding the documents exiting the reach of the secondary conveying belt in said inclined position.

9. The apparatus of claim 8 wherein said guide plate means is pivotally movable responsive to an increasing amount of documents stacked in said buffer means;

said apparatus including sensor means activated upon said guide plate means reaching a predetermined position of pivotal movement;

said sensor means connected to said means for engaging and sweeping the stacked documents to sweep the stacked documents from the buffer means to the corresponding receiving receptacle upon activation of said sensor means by said guide plate means.

10. The apparatus of claim 3 wherein said buffer means includes an end plate extending generally upward from a downstream end of said floor to align the plurality of documents as the documents engage the end plate.

11. The apparatus of claim 4 wherein said at least one prong extends upward through said slot in a first position adjacent a lateral edge of said floor, which edge is opposite the direction the stack of documents is pushed outward;

guide plate means pivotally mounted to said apparatus above said floor, said guide plate means being pivotally moveable responsive to an increasingly amount of documents stacked in said buffer means to guide said documents into said buffer means;

said guide plate means including lifting means for engaging said at least one prong as said prong reciprocates in a transverse direction across said floor, said lifting means raising said guide plate means out of the path of travel of said reciprocating at least one prong means.

12. The apparatus of claim 9 wherein said sensor means comprises a wand switch engaging a portion of said guide plate means, said wand switch moveable from a first deactivated position to a second activated position responsive to said pivotable movement of said guide plate means upon said documents entering said buffer means.

* * * * *